US005935922A

United States Patent [19]

Moss et al.

[11] Patent Number: 5,935,922

[45] Date of Patent: Aug. 10, 1999

[54] DETERGENT COMPOSITION CONTAINING ZEOLITE MAP FOR WASHING A MIXTURE OF WHITE AND COLORED FABRICS

[75] Inventors: Michael Alan J. Moss, Prudhoe; Christiaan A. J. K. Thoen, North Shields, both of United Kingdom

[73] Assignee: The Procter & Gamble Company, Cincinnati, Ohio

[21] Appl. No.: 08/702,666

[22] PCT Filed: Mar. 1, 1995

[86] PCT No.: PCT/US95/02699

§ 371 Date: Sep. 6, 1996

§ 102(e) Date: Sep. 6, 1996

[87] PCT Pub. No.: WO95/27028

PCT Pub. Date: Oct. 12, 1995

[30] Foreign Application Priority Data

Mar. 31, 1994 [GB] United Kingdom ..... 9406543

[51] Int. Cl.[6] ..... C11D 3/12; C11D 3/28

[52] U.S. Cl. ..... 510/276; 510/301; 510/324; 510/325; 510/337; 510/394; 510/507

[58] Field of Search ..... 510/276, 301, 510/324, 325, 360, 337, 475, 394, 507

[56] References Cited

U.S. PATENT DOCUMENTS

| | | | |
|---|---|---|---|
| 4,005,026 | 1/1977 | Heath et al. | 510/324 |
| 4,399,049 | 8/1983 | Gray et al. | 252/91 |
| 4,400,173 | 8/1983 | Beavan | 8/107 |
| 4,417,994 | 11/1983 | Stoddart | 252/135 |
| 5,409,627 | 4/1995 | Boskamp et al. | 510/311 |
| 5,466,802 | 11/1995 | Panandiker et al. | 510/324 |
| 5,478,500 | 12/1995 | Swift et al. | 510/350 |
| 5,478,502 | 12/1995 | Swift | 510/350 |
| 5,498,342 | 3/1996 | Chapple | 510/377 |
| 5,500,153 | 3/1996 | Figueroa et al. | 510/292 |
| 5,560,858 | 10/1996 | Fredj et al. | 510/320 |
| 5,565,420 | 10/1996 | Stearns | 510/358 |

FOREIGN PATENT DOCUMENTS

| | | | |
|---|---|---|---|
| 587 550 A1 | 3/1994 | European Pat. Off. | C11D 3/00 |
| 0 384 070 B1 | 9/1995 | European Pat. Off. | C11D 3/12 |
| 93/15175 | 8/1993 | WIPO . | |
| 94/01520 | 1/1994 | WIPO | C11D 1/02 |

*Primary Examiner*—Lorna Douyon
*Attorney, Agent, or Firm*—J. C. Rasser; K. W. Zerby; D. Mitchell Goodrich

[57] ABSTRACT

Detergent compositions comprise a surfactant selected from anionic, nonionic, cationic, amphoteric and zwitterionic detergent-active compounds and mixtures thereof; a detergency builder comprising zeolite P having a silicon to aluminium ratio not greater than 1.33; from 0.05% to 0.3%, by weight of the composition, anionic N-bonded stilbene optical brightener; and one or more additional components selected from manganese phthalocyaninetetrasulphonate and polymers selected from polyamine N-oxide polymers, copolymers of N-vinylpyrrolidone and N-vinylimidazole, polyvinylpyrrolidones, polyvinyloxazolidones, polyvinylimidazoles and mixtures thereof.

4 Claims, No Drawings

DETERGENT COMPOSITION CONTAINING ZEOLITE MAP FOR WASHING A MIXTURE OF WHITE AND COLORED FABRICS

TECHNICAL FIELD

The present invention relates to a detergent composition and, in particular, to improvements in the detergency performance of laundry detergent compositions comprising zeolites as a sequestering agent for water hardness.

BACKGROUND

Detergent compositions for heavy-duty fabric washing conventionally contain detergency builders which lower the concentration of calcium and magnesium water hardness ions in the wash liquor and thereby provide good detergency effect in both hard and soft water.

Conventionally, inorganic phosphates, such as sodium tripolyphosphate, have been used as builders for laundry detergents. More recently, alkali metal aluminosilicate ion-exchangers, particularly crystalline sodium aluminosilicate zeolite A, have been proposed as replacements for the inorganic phosphates.

For example, EP 21 491A (Procter & Gamble) discloses detergent compositions containing a building system which includes zeolite A, X or P (B) or a mixture thereof. EP 384070A (Unilever) discloses specific zeolite P materials having an especially low silicon to aluminium ratio not greater than 1.33 (hereinafter referred to) as zeolite MAP) and describes its use as a detergency builder. To date, however, zeolite A is the preferred aluminosilicate detergency builder in commercially available products.

EP 384070 (Unilever) suggests that zeolite MAP has certain advantages over zeolite A as a detergency builder. However, we have found that compositions containing zeolite MAP as detergency builder can result in poorer fabric whiteness, as compared with compositions containing zeolite A as detergency builder, in washing loads containing a mixture of coloured and white fabrics.

SUMMARY

Surprisingly, we have found that zeolite MAP gives good fabric whiteness performance when used in combination with specific fabric whitening agents and/or specific polymeric materials and/or with an oxidative catalyst.

Thus, the present invention provides a detergent composition comprising:

a) a surfactant selected from anionic, nonionic, cationic, amphoteric and zwitterionic detergent-active compounds and mixtures thereof;

b) a detergency builder comprising zeolite P having a silicon to aluminium ratio not greater than 1.33 (zeolite MAP); and c) one or more additional components selected from (i) anionic optical brighteners which are stilbene derivatives;

(ii) polymers selected from polyamine N-oxide polymers, copolymers of N-vinylpyrrolidone and N-vinylimidazole, polyvinylpyrrolidone polymers, polyvinyloxazolidones, polyvinylimidazoles or mixtures thereof; and (iii) manganese phthalocyaninetetrasulphonate.

DETAILED DESCRIPTION

The detergent composition according to the invention may be of any physical type, for example powders, liquids and gels. However, granular and liquid compositions are preferred.

Preferably the detergent composition according to the present invention contains no bleach.

The detergent composition according to the invention contains, as an essential ingredient, one or more surfactants selected from anionic, nonionic, cationic, amphoteric and zwitterionic detergent-active compounds and mixtures thereof. Such surfactants are well known and described in the literature, for example, in "Surface-Active Agents and Detergents", Volumes I and II by Schwartz, Perry and Berch.

Examples of suitable anionic surfactants include alkylbenzene sulphonates, particularly sodium linear alkylbenzene sulpionates having an alkyl chain length of $C_8$–$C_{15}$; $C_{12}$–$C_{15}$ primary alkyl sulphates; olefin sulphonates; alkyl xylene sulphonates; dialkyl sulphosuccinates; and fatty acid ester sulphonates. Sodium salts are generally preferred.

Examples of suitable nonionic surfactants include alkoxylated adducts of fatty alcohols containing an average of from 3 to 10 alkylene oxide groups per molecule.

A particularly preferred aliphatic alcohol ethoxylate is a primary alcohol having an average of from 12 to 15 carbon atoms in the alkyl chain condensed with an average of from five to seven ethoxy groups per mole of alcohol.

Other examples of suitable alkoxylated adducts of fatty alcohols are Synperonic A3 (ex ICI), which is a $C_{13}$–$C_{15}$ alcohol with about three ethylene oxide groups per molecule and Empilan KB3 (ex Marchon), which is lauric alcohol 3EO. Mixtures of such ethoxylated alcohols are also contemplated by the present invention.

Another class of nonionic surfactants comprises alkyl polyglucoside compounds of general formula $$RO(C_nH_{2n}O)_tZ_x$$

wherein Z is a moiety derived from glucose; R is a saturated hydrophobic alkyl group that contains from 12 to 18 carbon atoms; t is from 0 to 10 and n is 2 or 3; x is from 1.1 to 4, the compounds including less than 10% unreacted fatty alcohol and less than 50% short chain alkyl polyglucosides. Compounds of this type and their use in detergent compositions are disclosed in EP-B 0070074, 0070077, 0075996 and 0094118.

The surfactant will generally be included in the detergent composition in an amount of 5 to 60% by weight, preferably 5 to 40% by weight and most preferably from 10 to 25% by weight of the composition.

According to the present invention the detergency builder system is based on zeolite MAP, optionally in conjunction with one or more supplementary builders. The amount of zeolite MAP employed may range, for example, from 5 to 60 wt %, more preferably from 15 to 40 wt %.

Zeolite MAP is described in EP 384070A (Unilever). It is defined as an alkali metal alumino-silicate of the zeolite P type having a silicon to aluminium ratio not greater than 1.33, preferably within the range from 0.9 to 1.33 and more preferably within the range of from 0.9 to 1.2.

Of particular interest is zeolite MAP having a silicon to aluminium ratio not greater than 1.15 and, more particularly, not greater than 1.07.

Zeolite P having a Si:Al ratio of 1.33 or less may be prepared by the following steps:

(i) mixing together a sodium aluminate having a mole ratio $Na_2O:Al_2O_3$ within the range of from 1.4 to 2.0 and a sodium silicate having a mole ratio $SiO_2:Na_2O$ within the range of from 0.8 to 3.4 with vigorous stirring at a temperature within the range of from 25° C. to boiling point usually 95° C., to give a gel having the following composition;

$Al_2O_3$: (1.75–3.5) $SiO_2$: (2.3–7.5) $Na_2O$ :P (80–450) $H_2O$;

(ii) ageing the gel composition for 0.5 to 10 hours, preferably 2 to 5 hours, at a temperature within the range of from 70° C. to boiling point, usually to 95° C., with sufficient stirring to maintain any solids present in suspension;

(iii) separating the crystalline sodium aluminosilicate thus formed, washing to a pH within the range of from 10 to 12.5, and drying, preferably at a temperature not exceeding 150° C., to a moisture content of not less than 5 wt %.

Preferred drying methods are spray-drying and flash drying. It appears that oven drying at too high a temperature may adversely affect the calcium binding capacity of the product under certain circumstances.

Commercial sodium metasilicate pentahydrate dissolved in water and commercial sodium silicate solution (waterglass) are both suitable silica sources for the production of zeolite P in accordance with the invention. The reactants may be added together in any order either rapidly or slowly. Rapid addition at ambient temperature, and slow addition at elevated temperature (90–95° C.) both give the desired product.

Vigorous stirring of the gel during the addition of the reactants, and at least moderate stirring during the subsequent ageing step, however, appear to be essential for the formation of pure zeolite P. In the absence of stirring, various mixtures of crystalline and amorphous materials may be obtained.

Zeolite MAP generally has a calcium binding capacity of at least 150 mg CaO per g of anhydrous aluminosilicate, as measured by the standard method described in GB 1473201 (Henkel). The calcium binding capacity is normally 160 mg CaO/g and may be as high 170 mg CaO/g.

Although zeolite MAP like other zeolites contains water of hydration, for the purposes of the present invention amounts and percentages of zeolite are expressed in terms of the notional anhydrous material. The amount of water present in hydrated zeolite MAP at ambient temperature and humidity is generally about 20 wt %.

The zeolite MAP used in the present invention preferably has a particle size $d_{50}$ of 1 to 5 micrometres, for example 2.25 to 5 micrometres, particularly 2.75 to 5 micrometres.

The quantity "$d_{50}$" indicates that 50 wt % of the particles have a diameter smaller than that figure.

According to the invention zeolite MAP may be the sole builder component or it may be used in combination with an organic or inorganic cobuilder. According to a particular embodiment of the invention, zeolite MAP is the principal builder component.

Suitable organic cobuilders can be monomeric or polymeric carboxylates such as citrates or polymers of acrylic, methacrylic and/or maleic acids in neutralised form. Suitable inorganic cobuilders include carbonates and amorphous and crystalline lamellar sodium silicates.

Suitable silicates have the composition:

$$NaMSi_xO_{2x+1}, yH_2O$$

where M is sodium or hydrogen, preferably sodium; x is a number from 1.9 to 4; and y is a number from 0 to 20. Such materials are described in U.S. Pat. Nos. 4,664,839; 4,728,443 and 4,820,439 (Hoechst AG). Especially preferred are compounds in which x=2 and y=0. The synthetic material is commercially available from Hoechst AG as S-$Na_2$ $Si_2O_5$ (SKS6) and is described in U.S. Pat. No. 4,664,830.

The total amount of detergency builder in the granular composition ranges from 5 to 80 wt %, more preferably from 15 to 60 wt % and most preferably from 10 to 45 wt %.

According to the present invention the detergent composition comprises one or more additional components selected from (i) anionic optical brighteners which are N-bonded stilbene derivatives;

(ii) polymers selected from polyamine N-oxide polymers, copolymers of N-vinylpyrrolidone and N-vinylimidazole, polyvinylpyrrolidone polymers, polyvinyloxazolidones polyvinylimidazoles or mixtures thereof; and (iii) manganese phthalocyaninetetrasulphonate.

Examples of suitable anionic optical brighteners are compounds of the formula:

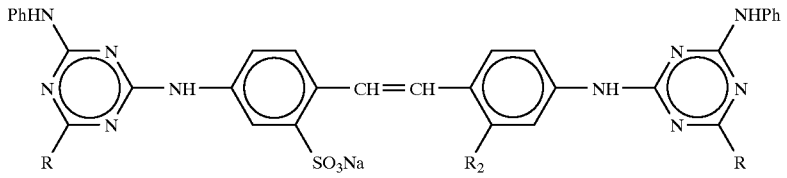

wherein

1. R=diethanolamino and $R_2$=$SO_3Na$:
2. R=morpholino and $R_2$=$SO_3Na$:
3. R=anilino, $R_2$=$SO_3Na$ or H; and
4. R=1-methyl-2-hydroxethylamino, R=$SO_3Na$.

Examples of less preferred anionic optical brighteners include compounds of the formula:

5.

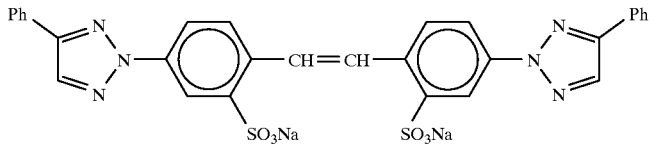

-continued

6. 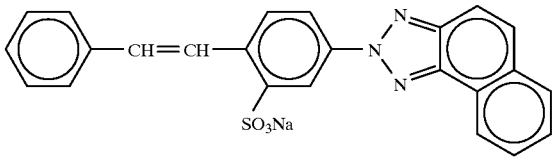

Compounds of formulae 1–4 above are preferred. The optical brightener is suitably incorporated in the composition in an amount of from 0.01 to 5.0 wt %, preferably in an amount of from 0.05 to 0.3 wt %.

Alternatively, or in addition, the detergent composition according to the invention includes a polymer. The polymers act as dye-transfer inhibiting agents by inhibiting the transfer of dyes from coloured fabrics onto fabrics washed therewith. These polymers have the ability to complex or adsorb the fugitive dyes washed out of dyed fabrics before the dyes have the opportunity to become attached to other articles in the wash.

Suitable polymers are polyamine N-oxide polymers copolymers of N-vinylpyrrolidone and N-vinylimidazole, polyvinylpyrrolidone polymers, polyvinyloxazolidones and polyvinylimidazoles or mixtures thereof.

The detergent composition may suitably comprise from 0.001 to 10 wt %, preferably from 0.01 to 2 wt % and most preferably from 0.05 to 1 wt % of the polymer.

Suitable polymers for use in the detergent composition according to the invention are described in detail in the following.

a) Polyamine N-oxide polvmers

The polymer N-oxide polymers suitable for use may contain units having the following structure formula:

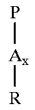

(I)

wherein P is a polymerisable unit, wherein the R-N-O group can be attached to or wherein the R-N-O group forms part of the polymerisable unit or a combination of both.

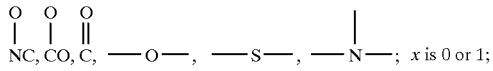

R are aliphatic, ethoxylated aliphatics, aromatic, heterocyclic or alicyclic groups or any combination thereof wherein the nitrogen of the N-O group can be attached or wherein the nitrogen of the N-O group is part of these groups.

The N-O group can be represented by the following general structure:

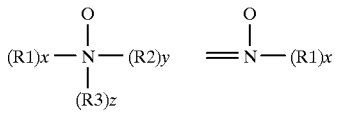

wherein R1, R2, and R3 are aliphatic groups, aromatic, heterocyclic or alicyclic groups or combinations thereof, x or/and y or/and z is 0 or 1 and wherein the nitrogen of the N-O group can be attached or wherein the nitrogen of the N-O group forms part of these groups.

The N-O group can be part of the polymerisable unit (P) or can be attached to the polymeric backbone or a combination of both.

Suitable polyamine N-oxides wherein the N-O group forms part of the polymerisable unit comprise polyamine N-oxides wherein R is selected from aliphatic, aromatic, alicyclic or heterocyclic groups. One class of said polyamine N-oxides comprises the group of polyamine N-oxides wherein the nitrogen of the N-O groups forms part of the R-group. Preferred polyamine N-oxides are those wherein R is a heterocyclic group such as pyrridine, pyrrole, imidazole, pyrrolidine, piperidine, quinoline, aridine and derivatives thereof.

Another class of said polyamine N-oxides comprises the group of polyamine N-oxides wherein the nitrogen of the N-O group is attached to the R-group.

Other suitable polyamine N-oxides are the polyamine oxides wherein the N-O- group is attached to the polymerisable unit. Preferred classes of these polyamine N-oxides are the polyamine N-oxides having the general formula (I) wherein R is an aromatic, heterocyclic or alicyclic group wherein the nitrogen of the N-O functional group is part of said R group.

Examples of these classes are polyamine oxides wherein R is a heterocyclic compound such as pyrridine, pyrrole, imidazole and derivatives thereof. Another preferred class of polyamine N-oxides are the polyamine oxides having the general formula (I) wherein R are aromatic, heterocyclic or alicyclic groups wherein the nitrogen of the N-O functional group is attached to said R groups.

Examples of these classes are polyamine oxides wherein the R groups can be aromatic such as phenyl.

Any polymer backbone can be used as long as the amine oxide polymer fcormed is water-soluble and has dye transfer inhibiting properties. Examples of suitable polymeric backbones are polyvinyls, polyakylenes, polyesters, polyethers, polyamide, polyimides, polyacrylates and mixtures thereof.

The amine N-oxide polymers of the present invention typically have a ratio of amine to the amine N-oxide of 10:1000000. However the amount of amine oxide groups present in the polyamine oxide polymer can be varied by appropriate copolymerisation or by appropriate degree of N-oxidation. Preferably, the ratio of amine to amine N-oxide is from 2:3 to 1:1000000. More preferably from 1:4 to 1:1000000, most preferably from 1:7 to 1:1000000. The polymers of the present invention actually encompass random or block copolymers where one monomer type is an amine N-oxide and the other monomer type is either an amine N-oxide or not. The amine oxide unit of the polyamine N-oxides has a Pka<10, preferably Pka<7, more preferred Pka<6.

The polyamine oxides can be obtained in almost any degree of polymerisation. The degree of polymerisation is not critical provided the material has the desired water-solubility and dye-suspending power. Typically, the average molecular weight is within the range of 500 to 100,000:

preferably from 1,000 to 50,000, more preferably from 2,000 to 30,000, most preferably from 3,000 to 20,000.

According to a particular aspect of the invention the detergent composition comprises from 0.01 to 1.5 wt % of polyvinylpyridine N-oxide.

b) Copolymers of N-vinylpyrrolidone and N-vinylimidazole

The N-vinylimidazole-N-vinylpyrrolidone polymers used in the present invention have an average molecular weight range from 5,000–1,000,000, preferably from 20,000–200,000.

Highly preferred polymers for use in detergent compositions according to the present invention comprise a polymer selected from N-vinylimidazole-N-vinylpyrrolidone copolymers wherein said polymer has an average molecular weight range from 5,000 to 50,000 more preferably from 8,000 to 30,000, most preferably from 10,000 to 20,000.

The average molecular weight range was determined by light scattering as described in Barth H. G. and Mays J. W. Chemical Analysis Vol 113, "Modern Methods of Polymer Characterization".

Highly preferred N-vinylimidazole-N-vinylpyrrolidone copolymers have an average molecular weight range from 5,000 to 50,000; more preferably from 8,000 to 30,000; most preferably from 10,000 to 20,000.

The N-vinylimidazole-N-vinylpyrrolidone copolymers characterised by having said average molecular weight range provide excellent dye transfer inhibiting properties while not adversely affecting the cleaning performance of detergent compositions formulated therewith. The N-vinylimidazole-N-vinylpyrrolidone copolymer of the present invention has a molar ratio of N-vinylimidazole to N-vinylpyrrolidone from from 1:1 to 0.2:1, more preferably from 0.8:1 to 0.3:1, most preferable from 0.6:1 to 0.4:1.

According to a particular aspect of the invention the detergent composition comprises from 0.01 to 1.5 wt % of polyvinylpyrrolidone-polyvinylimidazole copolymer.

c) Polyvinyloyrrolidone

The detergent compositions of the present invention may also utilize polyvinylpyrrolidone ("PVP" having an average molecular weight of from about 2,500 to about 400,000, preferably from about 5,000 to about 200,000, more preferably from about 5,000 to about 50,000, and most preferably from about 5,000 to about 15,000. Suitable polyvinylpyrrolidones are commercially available from ISP Corporation, New York, N.Y. and Montreal, Canada under the product names PVP K-15 (viscosity molecular weight of 10,000), PVP K-30 (average molecular weight of 40,000), PVP K-60 (average molecular weight of 160,000), and PVP K-90 (average molecular weight of 360,000). PVP K-15 is also available from ISP Corporation. Other suitable polyvinylpyrrolidones which are commercially available from BASF Corporation include Sokalan HP 165 and Sokalan HP 12. Polyvinylpyrrolidones known to persons skilled in the detergent field: see for example EP-A-262,897 and EP-A-256,696 are also suitable. According to a particular aspect of the invention the detergent composition comprises from 0.05 to 3.0 wt %, preferably from 0.1 to 0.3 wt % of PVP.

d) Polyvinyloxazolidone

The detergent compositions of the present invention may also utilize polyvinyloxazolidone as a polymeric dye transfer inhibiting agent. Said polyvinyloxazolidones have an average molecular weight of from about 2,500 to about 400,000, preferably from about 5,000 to about 200,000, more preferably from about 5,000 to about 50,000, and most preferably from about 5,000 to about 15,000.

e) Polyvinylimidazole

The detergent compositions of the present invention may also utilize polyvinylimidazole as polymeric dye transfer inhibiting agent. Said polyvinylimidazoles have an average Mv about 2,500 to about 400,000, preferably from about 5,000 to about 200,000, more preferably from about 5,000 to about 50,000, and most preferably from about 5,000 to about 15,000. "Preferably the magnesium phthalocyamnetetrasulphonate is present in an amount of from 0.01 to 1.0 wt % based on t he composition".

The detergent composition according to the invention may include the conventional detergent materials. However, preferably the composition is free of bleach. Other optional materials which may be present include, for example, enzymes, fluorescers, antiredeposition agents, inorganic salts such as sodium sulphate, lather control agents, fabric softening agents, pigments, coloured speckles and perfumes.

The detergent compositions of the invention may be prepared by any suitable method. The particulate detergent compositions are suitably prepared by any tower (spray-drying) or non-tower process.

In processes based around a spray-drying tower, a base powder is first prepared by spray-drying a slurry and then other components unsuitable for processing via the slurry can be sprayed on or admixed (postdosed).

The zeolite MAP is suitable for inclusion in the slurry, although it may be advantageous for processing reasons for part of the zeolite MAP to be incorporated post-tower.

Alternatively, particulate detergent compositions in accordance with the invention may be prepared by wholly non-tower processes such as granulation.

The granular detergent compositions of the invention may be prepared to any suitable bulk density. The compositions preferably have a bulk density of at least 400 g/l preferably at least 550 g/l, most preferably at least 700 g/l and, with particular preference at least 800 g/l.

The benefits of the present invention are particularly evident in powders of high bulk density, for example, of 700 g/l or above. Such powders may be prepared either by post-tower densification of spray-dried powder, or by wholly non-tower methods such as dry mixing and granulation; in both cases a high-speed mixer/granulator may advantageously be used. Processes using high-speed mixer/granulators are disclosed, for example, in EP340 013A, EP 367 339A, EP 390 251A and EP 420 317A (Unilever).

According to one aspect of the invention there is provided a granular detergent composition comprising:

from 5 to 60 wt %, preferably 5 to 40 wt %, of component (a) defined hereinbefore;

from 10 to 80 wt % of component (b) defined hereinbefore; and from 0.001 to 10 wt % of component (c) defined hereinbefore.

According to another embodiment of the invention there is provided a liquid detergent composition, preferably a heavy duty liquid detergent composition, comprising from 5 to 60 wt % of component (a) above and from 5 to 40 wt % of component (b) above and from 0.001 to 10 wt % of component (c) above.

According to this embodiment the liquid detergent composition may be of any convenient physical form which may be aqueous or anhydrous. The term "liquid" used herein includes partly viscous formulations such as gels. The liquid detergent composition generally has a pH of from 6.5 to 10.5.

The total amount of detergency builder in the liquid composition is preferably from 5 to 70% of the total liquid composition.

The following Examples provide illustrative detergent compositions according to the present invention.

The following abbreviations have been used:

LAS—linear $C_{12}$ alkyl benzene sulphonate

AS—sodium alkyl sulphate

TAS—sodium tallow alcohol sulphate

45E7—$C_{14-15}$ primary alcohol condensed with an average of 7 moles of ethylene oxide 25E3—$Cl_{2-15}$ primary alcohol condensed with an average of 3 moles of ethylene oxide PC3—percarbonate PB1—perborate monohydrate PB4—perborate tetrahydrate TAED—Tetraacetyl ethylene diamine PVP—polyvinyl pyrrolidone PYNO—polyvinylpyridine N oxide PVPVL—polyvinylpyrrolidone-polyvinylimidazole copolymer MnPC—manganese phthalocyaninetetrasulphonate.

EDTMP—ethylene diamine tetramethylene phosphonate

CMC—carboxymethyl cellulose

Brighteners 1, 2 and 3 correspond to the compounds of formulae 1, 2 and 3 respectively as defined in the description.

| | Examples | | | |
|---|---|---|---|---|
| | 1 | 2 | 3 | 4 |
| LAS | — | 7 | — | 5 |
| $C_{45}$ AS | 7 | — | — | — |
| $C_{24}$ AS | — | — | 5.6 | 3 |
| TAS | — | 5 | — | — |
| 45E7 | 7 | 4 | 6 | 5 |
| 25E3 | — | — | 2 | — |
| Glucamide | — | — | — | 5 |
| Zeolite MAP | 38 | 32 | 40 | 35 |
| Na SKS-6 | 5 | — | — | — |
| citrate | 10 | 12 | — | 10 |
| carbonate | 7 | 7 | 10 | 10 |
| silicate (2.0 ratio) | — | 6 | 5 | 5 |
| PC3 | 14 | — | — | — |
| PB1 | — | 10 | — | — |
| PB4 | — | 5 | — | 2 |
| TAED | 2.5 | 3 | — | — |
| Protease (Alcalase) | 2.0 | 2.0 | 2.0 | 2.0 |

-continued

| | Examples | | | |
|---|---|---|---|---|
| | 1 | 2 | 3 | 4 |
| Amylase (Termamyl) | 0.4 | 0.4 | 0.4 | 0.4 |
| Lipase (Lipolase) | 0.4 | 0.4 | 0.4 | 0.4 |

-continued

| | Examples | | | |
|---|---|---|---|---|
| | 1 | 2 | 3 | 4 |
| PVP | 1.0 | — | — | — |
| PVNO | — | 0.5 | — | — |
| PVPVI | — | — | 0.5 | — |
| MnPC | — | — | — | 0.2 |
| EDTMP | 0.1 | 0.2 | 0.1 | 0.1 |
| CMC | 0.8 | 0.6 | 0.8 | 0.8 |
| Suds Suppressor | | | | |
| Brightener 1 | — | 0.2 | — | |
| 2 | 0.2 | — | 0.2 | — |
| 3 | — | — | — | 0.2 |
| Moisture, sulphate and miscellaneous | 6.6 | 4.7 | 27.0 | 15.9 |
| | 100 | 100 | 100 | 100 |

We claim:

1. A detergent composition for washing loads containing a mixture of colored and white fabrics comprising by weight of the composition:

(a) from about 10% to about 25% of a surfactant;

(b) from about 15% to about 40% of zeolite MAP having a silicon to aluminum ratio of not greater than 1.33;

(c) from about 0.01% to about 10% of manganese phthalocyaninetetrasulphonate and (d) from 0.01% to 5% anionic N-bonded stilbene optical brightener;

wherein the composition is free of a polymer selected from the group consisting of polyamine N-oxide polymers, copolymers of N-vinylpyrrolidone and N-vinylimidazole, polyvinylpyrrolidones, polyvinyloxazolidones, polyvinylimidazoles and mixtures thereof.

2. A detergent composition according to claim 1, comprising from 0.05% to 0.3%, by weight, anionic N-bonded stilbene optical brightener.

3. A detergent composition according to claim 1, wherein the optical brightener has the formula:

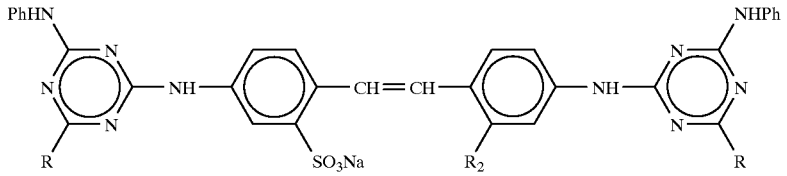

wherein R represents diethanolamino and $R_2$ represents —$SO_3Na$; or R represents morpholino and $R_2$ represents —$SO_3Na$; or R represents anilino and $R_2$ represents H or —$SO_3Na$; or R represents 1-methyl-2-hydroxethylamino and $R_2$ represents —$SO_3Na$.

4. A detergent composition according to claim 1, wherein the composition is in the form of a liquid and has a pH of from 6.5 to 10.5.

* * * * *